United States Patent [19]

Rahrig et al.

[11] Patent Number: 4,717,359

[45] Date of Patent: Jan. 5, 1988

[54] ARRANGEMENT FOR SECURING ELECTRICAL TERMINAL IN TERMINAL HOLDER

[75] Inventors: Thomas F. Rahrig, Antwerp, Ohio; Thomas E. Hall, Fort Wayne, Ind.

[73] Assignee: United Technologies Automotive, Inc., Dearborn, Mich.

[21] Appl. No.: 850,459

[22] Filed: Apr. 10, 1986

[51] Int. Cl.[4] ..... H01R 13/40

[52] U.S. Cl. ..... 439/595; 439/598; 439/871

[58] Field of Search ..... 339/59 R, 59 M, 61 R, 339/61 L, 61 M, 63 R, 63 M, 217 R, 217 S, 220 R, 220 L

[56] References Cited

U.S. PATENT DOCUMENTS

| | | | |
|---|---|---|---|
| Re. 27,463 | 8/1972 | Sitzler et al. | 339/59 R |
| 3,178,674 | 4/1965 | Scheller | 339/217 S |
| 3,808,578 | 4/1974 | Hansen | 339/217 S |
| 4,127,314 | 11/1978 | Hasimoto | 339/217 S |
| 4,241,967 | 12/1980 | Collins | 339/59 M |
| 4,443,048 | 4/1984 | Moist, Jr. | 339/63 M |
| 4,557,542 | 12/1985 | Coller et al. | 339/217 S |

FOREIGN PATENT DOCUMENTS

| | | | |
|---|---|---|---|
| 2508722 | 12/1982 | France | 339/59 M |

*Primary Examiner*—Gil Weidenfeld
*Assistant Examiner*—David Pirlot
*Attorney, Agent, or Firm*—Stephen A. Schneeberger

[57] ABSTRACT

An improved arrangement for retaining a terminal in a terminal holder includes providing a mounting opening through a wall of the terminal and provides a resilient snap-lock extending from the surface of a support member of the holder. The snap-lock extends through the terminal mounting opening for preventing relative longitudinal motion of the terminal in the holder and for yieldably restricting relative motion of the terminal substantially normal to the support member of the holder. The snap-lock has two locking fingers extending in "V"-shape fashion from the support member, which is preferably the holder's base. The locking fingers include camming surfaces to facilitate mounting the terminal on the locking fingers by moving the terminal transverse to its longitudinal extent. The holder is open at its top to facilitate mounting and removal of a terminal. A connector housing may be provided to removably close that opening.

10 Claims, 22 Drawing Figures

10
11
12
14
15
16
18
20
44
67
90
92
94
96

FIG. 5
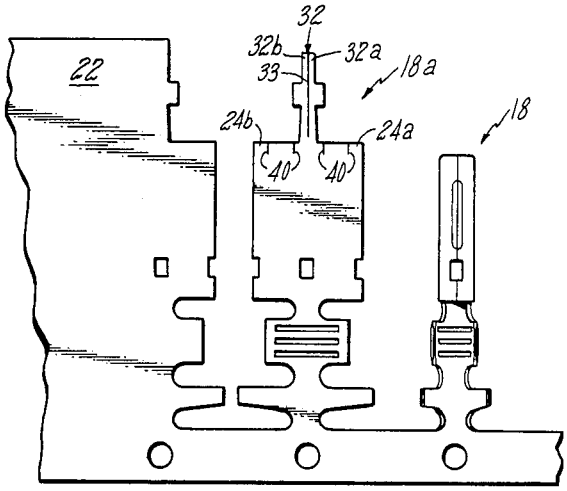
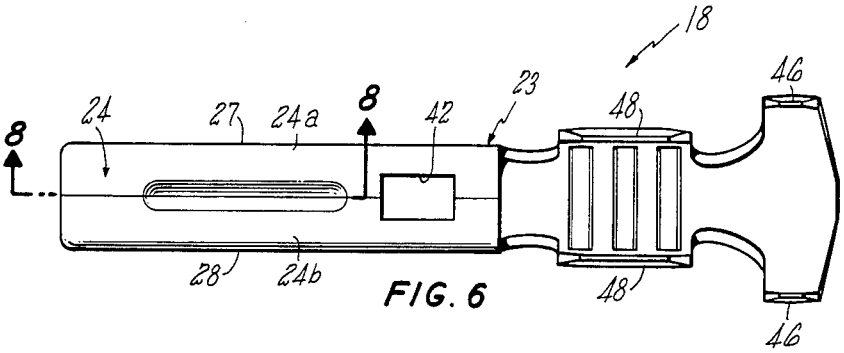
FIG. 6
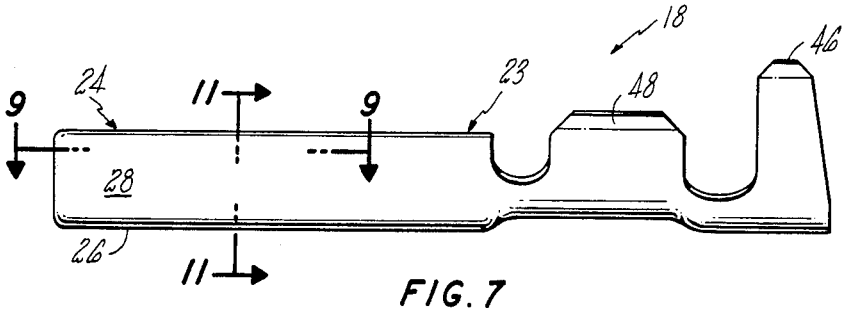
FIG. 7

FIG. 12
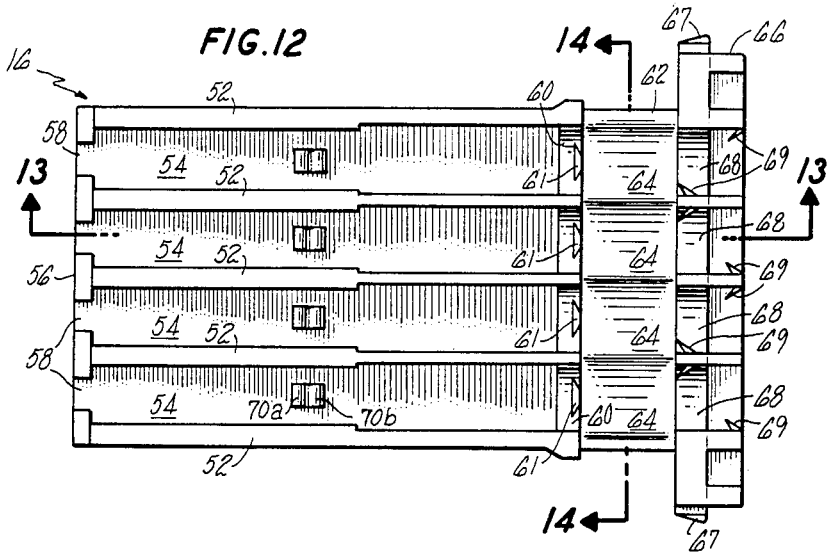
FIG. 13
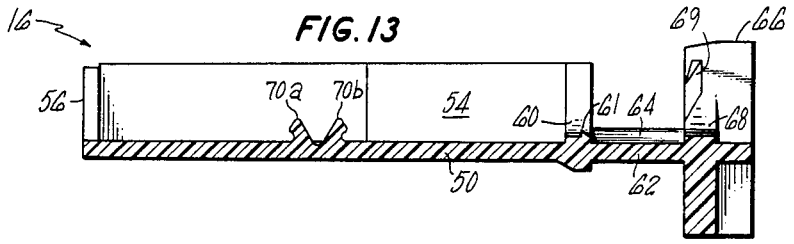
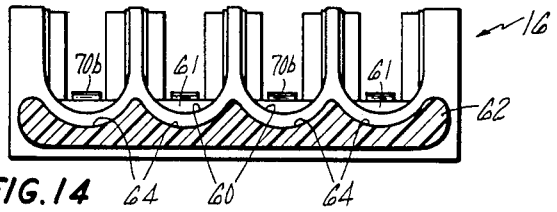
FIG. 14
FIG. 15
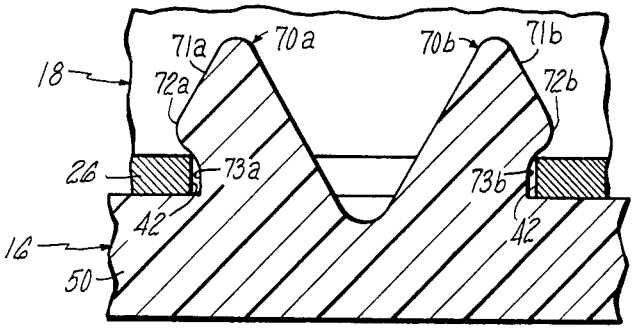

FIG. 18
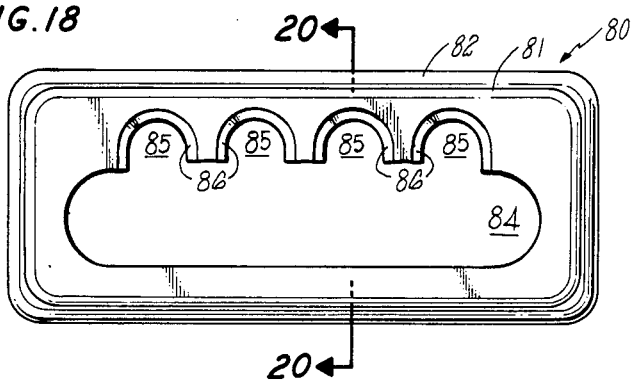
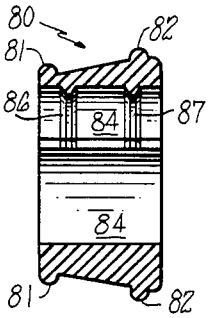
FIG. 20
FIG. 19
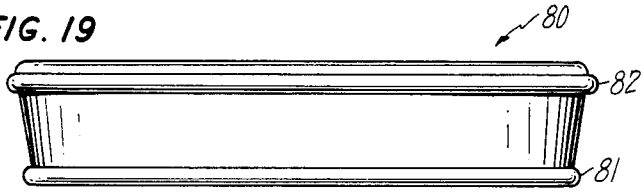
FIG. 21
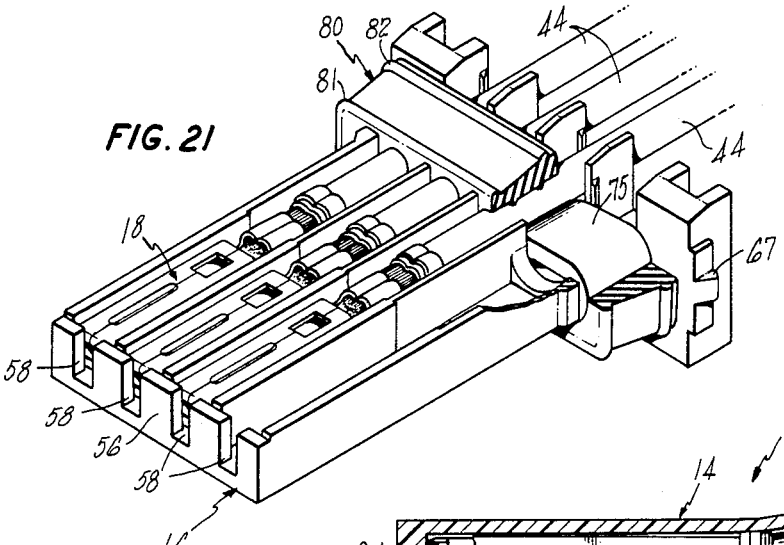
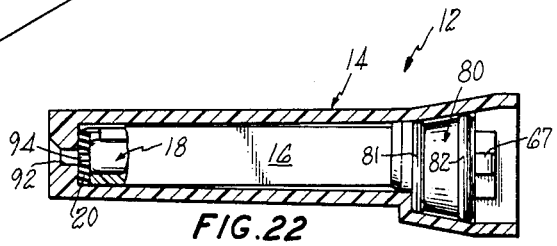
FIG. 22

ARRANGEMENT FOR SECURING ELECTRICAL TERMINAL IN TERMINAL HOLDER

CROSS-REFERENCE TO RELATED PATENT APPLICATIONS

This application is related to the subject matter disclosed and claimed in patent application Ser. No. 850,458 for ELECTRICAL RECEPTACLE TERMINAL by Thomas F. Rahrig and Thomas E. Hall, and patent application Ser. No. 850,460 for SEALED ELECTRICAL CONNECTOR ASSEMBLY by Thomas F. Rahrig and Thomas E. Hall, said applications filed on even date herewith and assigned to the same assignee.

1 Technical Field

The invention relates to an arrangement for securing an electrical terminal to a terminal holder.

2. Background Art

In various types of electrical connector assemblies it is generally necessary to secure or lock the terminals into operative positions within some part of the connector. This is required to protect the terminals, and to facilitate assembly of the connector, and particularly to insure that the terminals remain oriented so as to receive a mating terminal or conductor device. In some instances, the terminals are thus secured by integrally molding them with a molded connector body. In other instances typified by U.S. Pat. Nos. 4,479,691; 4,531,808; and 4,560,231, a ported connector block receives a terminal via longitudinal insertion into the port and a snap-lock member on either the block or the terminal cooperatively engages a mating portion of the other element to secure the terminal. Yet other types of connector assemblies employ a separate terminal holder (sometimes called a "housing"), and a housing into which the terminal holder is installed (sometimes referred to as a "cover" or "shroud" ). In this latter type the terminals may be secured in position by latching tangs on the terminal when longitudinally inserted, as depicted in U.S. Pat. No. 4,277,124, or may be less securely retained by a captive geometry being provided to the channel into which the terminal is seated as in U.S. Pat. No. 4,255,009.

While each of the foregoing arrangements does to some degree retain a terminal in a holder, they may do so without allowing subsequent easy removal of the terminal, or they may require a complex locking structure and assembly, or they may be limited to installation in a single orientation.

It is an object of the invention to provide an improved arrangement in a connector assembly for securely retaining a terminal in a terminal holder. Included in this object is the provision of such a retaining arrangement which also affords installation and subsequent removal of the terminal from the holder in a relatively easy manner.

It is a further object to provide a terminal and terminal securing arrangement which allows the terminal to be mounted in a plurality of orientations about its longitudinal axis.

3. Disclosure of Invention

According to the invention there is provided in a connector assembly including at least a terminal holder and an elongate terminal mounted in operative association with the holder, and an improved arrangement for retaining the terminal in the holder. The terminal may be a receptacle terminal having one, or preferably a pluralty of opposed mounting openings extending transversely through respective longitudinal walls thereof, and the terminal holder includes resilient snap-lock means extending from a support surface through the mounting opening in the terminal for substantially preventing longitudinal motion of the terminal relative to the holder and for yieldably restricting relative motion of the terminal substantially normal to the support surface of the holder.

The snap-lock means is provided by at least two locking fingers extending from the holder's support surface in resiliently deflectable, divergent fashion, as in a "V"-shaped configuration. When unflexed, the span of the locking fingers exceeds that of the mounting opening. A comming surface on each of the locking fingers is engaged by the edge of the mounting opening in the terminal for deflecting the fingers relatively toward each other when the terminal is moved toward the support surface. The terminal holder may be of plastic subdivided into multiple channels, each channel having a base from which the locking fingers extend for receiving a respective terminal. Each channel of the terminal holder is open at its top to facilitate insertion and withdrawal of a terminal. A connector housing is adapted to receive the terminal holder to close the open top sides of the channels in the holder.

BRIEF DESCRIPTION OF THE DRAWINGS

FIG. 5 is a plan view of several stages of the blank from which the receptacle terminal of FIGS. 3 and 4 is formed;

FIG. 6 is a plan view of the terminal of FIG. 3;

FIG. 7 is a side elevation view of the terminal of FIG. 6;

FIG. 12 is a top plan view of the terminal holder of the assembly of FIG. 2;

FIG. 13 is a sectional view of the terminal holder of FIG. 12, taken along line 13—13 thereof and showing a terminal-locking element;

FIG. 14 is a sectional view of the terminal holder of FIG. 12 taken along line 14—14 thereof;

FIG. 15 is an enlarged partial view of the terminal holder of FIG. 13 showing the terminal locking element in greater detail and including a terminal disposed thereat;

FIG. 18 is a front view of a second seal;

FIG. 19 is a top view of the seal of FIG. 18;

FIG. 20 is a sectional view of the seal of Fig. 18 taken along line 20—20 thereof;

FIG. 21 is a perspective view, partly broken away, of a terminal holder and terminals following the installation of the first and second seals; and FIG. 22 is a side view of the receptacle terminal assembly of FIG. 1, partly broken away and partly in section to further illustrate the sealing arrangement.

BEST MODE FOR CARRYING OUT THE INVENTION

Figures 1, 2:
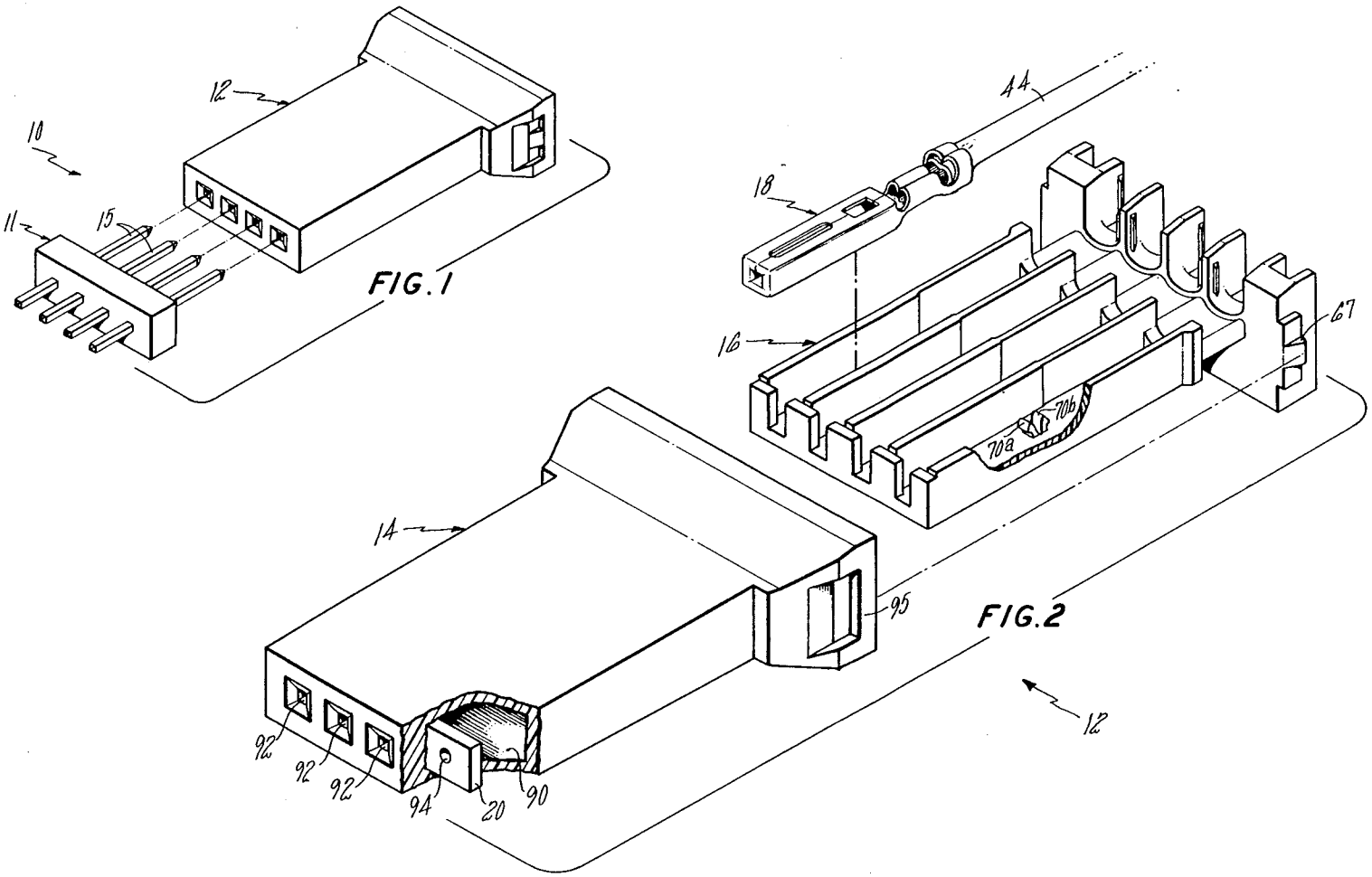
FIG. 1 is an exploded perspective view of a connector system, including a receptacle terminal connector assembly in accordance with the invention.
FIG. 2 is an exploded perspective view of part of the receptacle terminal connector assembly, showing the connector housing, terminal holder, a terminal and a face seal.
Figure 3:
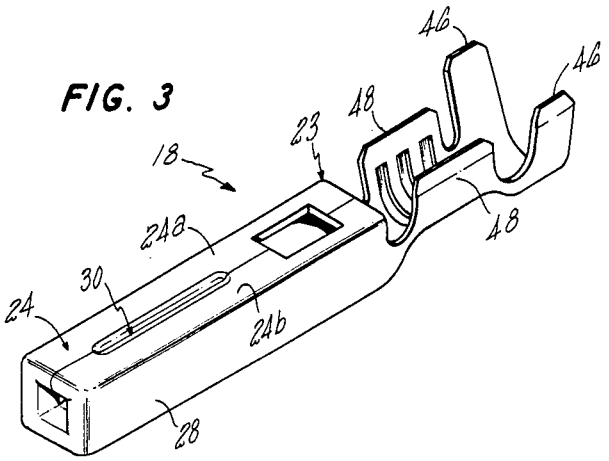
FIG. 3 is a perspective view of a receptacle terminal.
Figure 4:
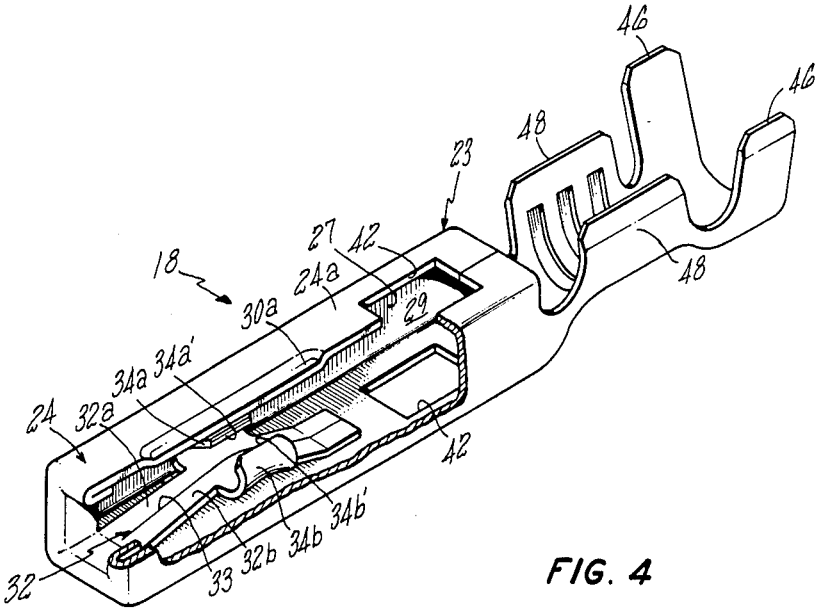
FIG. 4 is a perspective view of the terminal of FIG. 3, partly broken away to reveal the structure for supporting a pin terminal.
Figure 8:
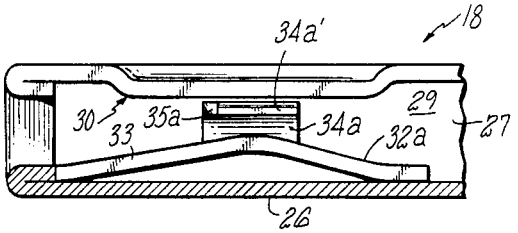
FIG. 8 is a sectional view of the terminal of FIG. 6, taken along line 8—8 thereof.
Figure 9:
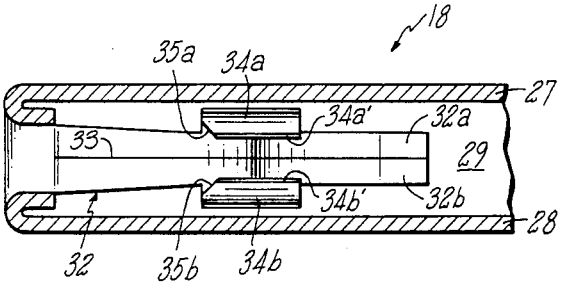
FIG. 9 is a sectional view of the terminal of FIG. 7, taken along line 9—9 thereof.
Figure 10:
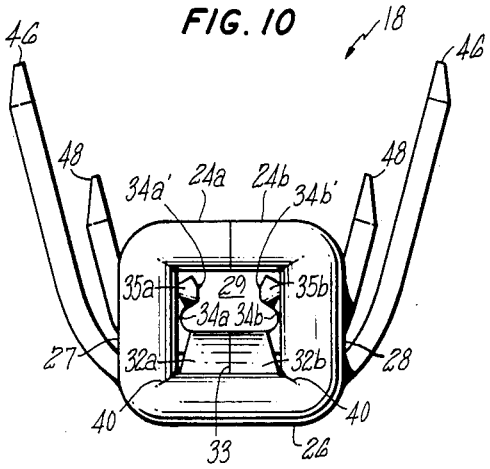
FIG. 10 is a front end view of the receptacle terminal of FIGS. 3, 4, 6 and 7.

Referring to the Figures, and particularly Fig. 1, there is illustrated an electrical connector system 10 comprising a pin terminal connector assembly 11 and a receptacle terminal connector assembly 12. the system 10 is intended for, though not limited to, use in an automobile or similar vehicle. Accordingly, the system is relatively small and compact and is designed to resist the often hostile environment. The pin terminal connector 11 includes one or more, in this instance four, pin terminals 15, or simply pins, adapted for insertion into mated electrical engagement with respective receptacle terminals in the receptacle terminal connector 12. The pins 15 may be spaced 0.10 inch or more on centers and have a principal cross-sectional dimension of 0.025 inch. In the illustrated embodiment the pins 15 are of rectangular or square cross section, but they might also be round.

Referring to FIG. 2, the receptacle terminal connector assembly 12, or simply receptacle connector, is illustrated in greater detail. Receptacle connector 12 includes a connector housing 14, a multi-channeled terminal holder 16, and four receptacle terminals 18, only one being illustrated in this Figure. A face or end seal 20 is also depicted in connector housing 14 to aid in providing a sealed environment. Additional sealing members, not shown in FIG. 2, may also be provided as will be described hereinafter in greater detail.

Referring to FIGS. 3–11, there is depicted a novel arrangement for a receptacle terminal 18. Referring specifically to FIG. 5, receptacle terminal 18 is formed from a suitably-conductive sheet metal blank 22 by conventional stamping and bending techniques. The intermediate form, designated 18*a* in FIG. 5, represents the terminal 18 following most or all of the stamping operation and prior to bending into the final form, designated 18. The terminal 18 has a longitudinal body 23 for receiving a pin terminal 15 as in FIGS. 1 and 11. The body 23 of terminal 18 is rectangular or square in cross section transverse to its longitudinal axis, through it will be understood that other geometries including circular might similarly apply. The terminal body 23 includes a top wall 24, an opposing bottom wall 26 and a pair of opposed, connecting side walls 27 and 28 which define an interior cavity 29. One of the walls, in this instance upper wall 24, is provided with one or more longitudinal bosses or ribs 30 extending relatively into the cavity 29. In the illustrated embodiment, the upper wall 24 of terminal body 23 is formed by folding a pair of elongated tabs 24*a* and 24*b* into opposing and substantially abutting relation. Each half of the rib 30 is formed by a respective rib-half 30*a* and 30*b*. Each of the rib halves 30*a* and 30*b* is formed by an extrusion or stamping process which creates an upset in the metal of the terminal. Each of the rib halves 30*a* and 30*b* preferably includes a flat surface at its innermost extreme such that the rib 30 correspondingly includes a flat surface for increased area in contact with the pin terminal 15.

Opposing the rib 30 is a spring arrangement, generally designated 32, for electrically contacting and resiliently supporting a pin terminal 15. More specifically, a beam spring 32 extends rearwardly into the cavity 29 from the front end of the terminal body 23 and is longitudinally divided or bifurcated from its distal end forwardly by a slit 33 to provide a pair of spring arms 32*a* and 32*b*. Spring arms 32*a* and 32*b* are generally of convex shape such that their midportions extend upwardly into cavity 29 a greater distance than their respective end portions. More particularly, the opposite ends of the spring arms 32*a* and 32*b* are in engagement with the bottom wall 26, with the proximal or forward end of each spring being formed as an integral portion of the terminal body 23. Additionally, each of the spring arms 32*a* and 32*b* includes a respective flange 34*a* and 34*b* along its midportion. The flanges 34*a* and 34*b* extend laterally outward from the outer edges of the respective spring arms 32*a* and 32*b* and are curved upwardly and inwardly to present a pair of spaced, substantially opposing, longitudinally-extending end surfaces 34*a*′ and 34*b*′.

Figure 11:
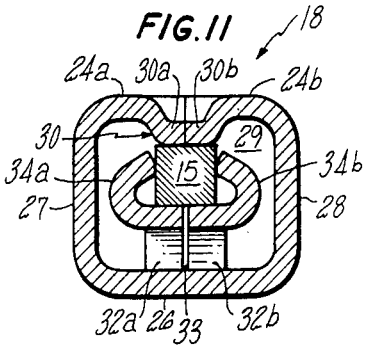
FIG. 11 is a sectional view of the terminal of FIG. 7 taken along line 11—11 thereof.

Because spring arms 32*a* and 32*b* are separate at least along the region in which they are inwardly bowed to the greatest extent into the cavity 29, each may act independently to resiliently urge an inserted pin terminal 15 (as illustrated in FIG. 11) into engagement with the longitudinal rib 30-formed in the upper wall 24. Such arrangement has the advantage of enhancing and ensuring opposing contact between the rib 30 and at least one or the other of the beam spring arms 32*a* and 32*b* in the event the terminal 18 is subjected to shock or vibration. Even further, the flanges 34*a* and 34*b* on the respective spring arms 32*a* and 32*b* are contoured and dimensioned such that their end faces 34*a*′ and 34*b*′ resiliently engage opposite faces of the pin terminal 15, generally in quadrature with the regions of contact provided by the spring arms 32*a*, 32*b* and the rib 30. The normal spacing between the opposed faces 34*a*′ and 34*b*′ of the flanges 34*a* and 34*b* prior to insertion of a pin terminal 15 is slightly less than the width of the pin terminal. To facilitate the lead-in of a pin terminal 15 into the space between flanges 34*a* and 34*b*, the forward edges of those flanges are rearwardly inclined at 35*a* and 35*b* respectively. Each of the spring arms 32*a* and 32*b* is sufficiently long, narrow and thin, being about 0.190, 0.012, and 0.008 inch, respectively, that when a pin terminal 15 is inserted between flanges 34*a* and 34*b*, the spring arms are resiliently flexed and relatively spaced in a lateral direction as shown in FIG. 11. This insures that the flanges 34*a* and 34*b* resiliently engage pin terminal 15 and that each of the spring arms operates relatively independent of the other. Such arrangement provides multidirectional stability to the contact between the pin terminal 15 and the receptacle terminal 18. Each of the surfaces of receptacle terminal 18 which engages the pin terminal 15 typically is of significant longitudinal extent thereby to provide both stability and to increase the area of mechanical and electrical contact. This has the advantage of minimizing localized wear spots and the high resistance paths associated with very small areas of contact.

Referring to FIG. 11 in which a pin terminal 15 is shown inserted into a receptacle terminal 18, it will be noted that both electrical contact and support are provided to the pin terminal by at least five distinct regions of the terminal 18. Specifically, the upper surface of each of the two spring arms 32*a* and 32*b* provides such support and contact surfaces, the opposing end faces 34*a'* and 34*b'* of the flanges 34*a* and 34*b* provides another two such support and contact surfaces and the longitudinal rib 30 provides a fifth such surface.

With respect to the support and contact surface provided by the rib 30, it should be understood that although the spring arms 32*a* and 32*b* are sufficiently independent and resilient to provide independent support surfaces, a much larger area of material is employed in forming the tabs 24*a* and 24*b* which combine to form the upper wall 24 and, accordingly, the rib 30 is much less resilient. In fact, rib 30 may be viewed as being a relatively rigid, elongated contact surface. It is generally preferable to form the upper wall tabs 24*a* and 24*b* in contacting relation along their longitudinal seam for preserving the structural integrity of the terminal and minimizing openings through which the pin terminal 15 might be deflected.

However, in the event it is permissible or desirable to provide a small space between the upper wall tabs 24*a* and 24*b*, the rib portions 30*a* and 30*b* formed along the edges of the respective wall tabs will each define separate longitudinal ribs spaced a small distance from one another and thus provide an additional, or sixth, region of contact between terminal 18 and pin terminal 15. Should it be desirable to have two spaced ribs, such as rib halves 30*a* and 30*b*, yet also to maintain the wall tabs 24*a* and 24*b* in contacting relation, each of the rib segments 30*a* and 30*b* might be formed relatively more toward the adjacent wall portions 27 and 28 and each define 180° curved surfaces.

Referring to FIG. 5, and particularly to the terminal blank 18*a* therein, it will be noted that the spring member 32 is formed and bifurcated to provide the separate spring arms 32*a* and 32*b*. Additionally, the forward end of the partially-shaped terminal blank has longitudinally pierced slots extending for a short distance at each of four positions 40. The slot positions 40 correspond with the four corners of the resulting receptacle terminal 18. More specifically, as more clearly seen in FIGS. 3, 4 and 8–10, the slot positions 40 enable the short wall flaps therebetween to be folded inward and rearward at substantially 180°. This strengthens the forward end of terminal 18 and importantly also results in its forward end face being inwardly tapered by the curvature of the bend, which thus aids in directing a pin terminal 14 into alignment with the interior cavity 29 and the several contacting surfaces provided by spring arms 34*a*, 34*b*, flange surfaces 34*a'* and 34*b'* and the rib 30. Moreover, the forward end of the receptacle terminal 18 is also thus seen to provide a continuous closed surface for preventing inadvertent misalignment or misdirection of a skewed pin terminal 15 during insertion.

Rearwardly of the spring 32 in the body portion 23 of receptacle terminal 18 there is additionally provided at least one, and preferably two openings, 42, each provided through a respective different one of the walls thereof for securing the terminal 18 in position within terminal holder 16, as will be hereinafter described in greater detail. The openings 42 are preferably formed through the bottom wall 26 and the top wall 24, are opposite one another and have the same geometry and dimensioning. More specifically, the openings 42 may typically be rectangular and slightly elongated along the longitudinal axis of the receptacle terminal 18.

Rearwardly of the main terminal body 23, the receptacle terminal 18 also includes structure for gripping a conductor wire 44 in a conventional manner, as depicted in FIGS. 2 and 21. As used herein, the phrase "conductor wire" is intended to mean not only an electrical conductor but also any insulation which might surround that conductor. More specifically, that gripping structure includes a first pair of jaws 46 which are formed to grippingly engage insulation on the conductor wire-44 and a second pair of jaws 48 which are in good electrical and mechanical contact with the electrically conductive center core of the conductor wire 44. Instead of the configuration of jaws 46 and 48 as depicted in the illustrated embodiment, it will be understood that other arrangements are similarly applicable for gripping a conductor wire 44. For instance, any of several suitable insulation-displacing connector designs (IDC) might be used if it is desired to both grip the insulation and engage the conductive core of the conductor wire 44 without additional preparation of that wire.

Referring to FIGS. 2, 12–15 and 21, the structure and function of the terminal holder 16 will be considered in greater detail. The terminal holder 16 is preferably rigid and formed of injection-molded plastic. The terminal-receiving portion of the terminal holder 16 includes a base 50 for generally supporting the receptacle terminals 18 in substantially coplanar relation with one another and further includes a plurality of longitudinally-extending walls 52 extending upwardly from the support base 50 to define a plurality, (in this instance four) terminal-receiving cavities or channels 54. The height of the walls 52 from base 50 is such that they extend somewhat above the upper surface of the receptacle terminals 18 when seated in the channels 54, as illustrated in FIG. 21. Further, the forward end of the terminal holder 16 is generally closed by a forward end wall 56 which includes four laterally-spaced entry port slots 58 extending downwardly from the top thereof to the support surface of base 50.

At the rear end of the terminal-supporting cavity of terminal holder 16 there are provided shallow, arcuate lands 60 aligned with the respective terminal channels 54 for supporting a portion of the rounded conductor wires 44. Each land 60 includes a small tang 61 for engaging the insulation on a conductor wire 44 to provide strain relief. Extending rearward from the terminal-containing portion of the terminal holder 16 is a relatively thin platform 62 formed integrally therewith and including a series of side-by-side shallow, arcuate channels 64 in the upper surface thereof, laterally aligned with the lands 60 and the terminal-receiving channels 54. The platform 62 and the respective channels 64 therein also serve to support the conductor wires 44 in substantially coplanar relation with one another and additionally to provide a surface for a sealing member as will be hereinafter described in greater detail. The base of each of the arcuate channels 64 is downwardly offset somewhat from the base of the respective arcuate lands 60 in order to accommodate the thickness of the mentioned sealing member. Finally, at the rear end of the terminal holder 16 there is provided a flange 66 affixed to the rear end of platform 62 and disposed transverse to the longitudinal extent of the holder. The width of the flange 66 is greater than that of the remaining portion of the terminal holder 16 and includes a pair of locking tabs 67 on its opposite, outward ends for locking engagement with the connector housing 14. The dimensioning of the flange 66 in the vertical direction is such that it extends both above and below any remaining portion of the terminal holder 16. A series of four side-by-side, longitudinally-extending slots 68 extend downwardly into the flange 66 and are provided with arcuate bases for supporting the respective conductive wires 44 substantially in registry with the arcuate support surfaces 60. A pair of small tangs 69 exist in each of the slots 68 for engaging the insulation on conductor wire 44 to provide strain relief.

Referring to FIGS. 2, 4 and 12–15, the receptacle terminals 18 are securely retained within the respective channels 54 of terminal holder 16 by a novel locking arrangement in which a pair of snap-lock fingers 70*a* and 70*b* are in locking engagement with a respective terminal 18 through a corresponding one of the openings 42 therein. Each of the terminal-receiving channels 54 of the terminal holder 16 is provided with a respective pair of snap-lock fingers 70*a* and 70*b* extending upwardly from the surface of the base support member 50. The snap-lock fingers 70*a* and 70*b* are formed integrally with the remainder of the body of terminal holder 16 and are of such geometry and dimensioning as to afford at least a limited degree of resilience to allow locking engagement with a respective terminal 18, and preferably also to permit unlocking therefrom. The snap lock fingers 70*a* and 70*b* are oriented in "V"-shape fashion relative to one another and, in the illustrated embodiment, are relatively longitudinally displaced in a respective terminal channel 54. It will be appreciated that other orientations, as for instance transverse to channel 54, might similarly be applicable.

Each of the snap-lock fingers 70*a*, 70*b* is provided with a respective camming surface 71*a*, 71*b* on a respective longitudinally-outward surface thereof for facilitating the relative introduction of the snap-lock fingers into a corresponding opening 42 in a terminal 18. The dimensioning of the snap-lock fingers 70*a*, 70*b* and the amplitudes or lengths of the respective camming surfaces 71*a*, 71*b* are such that the respective camming surfaces are engaged by the edges of bottom wall member 26 which define the opening 42 in the terminal 18. The terminal 18 may then be moved relatively toward the base surface 50 of the terminal holder 16 to relatively insert the snap-lock fingers 70*a*, 70*b* through the opening 42. The camming surfaces 71*a*, 71*b*, of the respective snap-lock fingers 70*a*, 70*b*, extend outward from the center of the respective fingers a sufficient distance to extend beyond the perimeter of the opening 42 in the terminal 18. That outer surface of each of the snap-lock fingers 70*a*, 70*b*, is then contoured or recurved relatively inwardly to provide respective lobes 72*a*, 72*b* and respective recesses 73*a*, 73*b*. Following insertion of the snap-lock fingers 70*a*, 70*b* through the opening 42 of terminal 18, the lobes 72*a*, 72*b* flex outwardly to extend beyond the perimeter of the opening 42 and a portion of the base wall 26 of the terminal 18 is received in the respective recesses 73*a*, 73*b* in the locking fingers. Such arrangement serves to securely retain the terminal 18 in a desired position within its respective channel 54 in the holder 16 and in alignment with a respective entry port 58.

The snap-lock fingers 70*a* and 70*b* are sufficiently resilient as to permit subsequent removal of a terminal 18 from locked engagement therewith as by applying a relative lifting force to the terminal, typically, via its rearward end and/or the conductor wire 44. It will be understood that by providing a plurality of mounting openings 42 in a respective terminal 18, that terminal might be mounted and locked in a corresponding plurality of orientations about its longitudinal axis. Moreover, it will be understood that a terminal holder might be provided having terminals locked in respective channels on opposite sides of a common base member to provide two rows of terminals.

Figure 16:
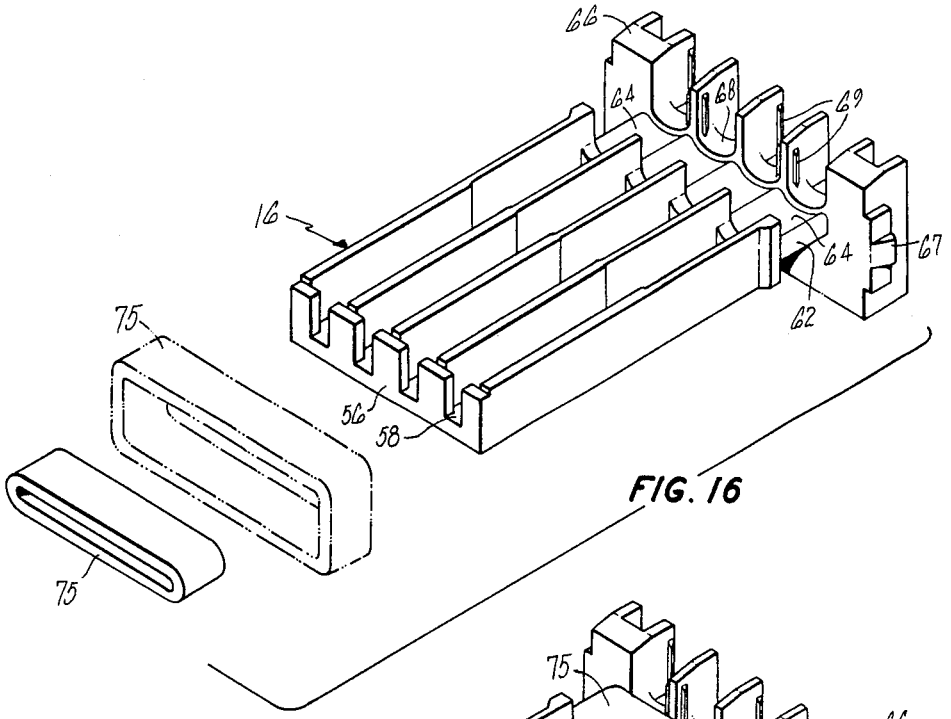
FIG. 16 is an exploded view of the terminal holder and a first seal therefor prior to installation.
Figure 17:
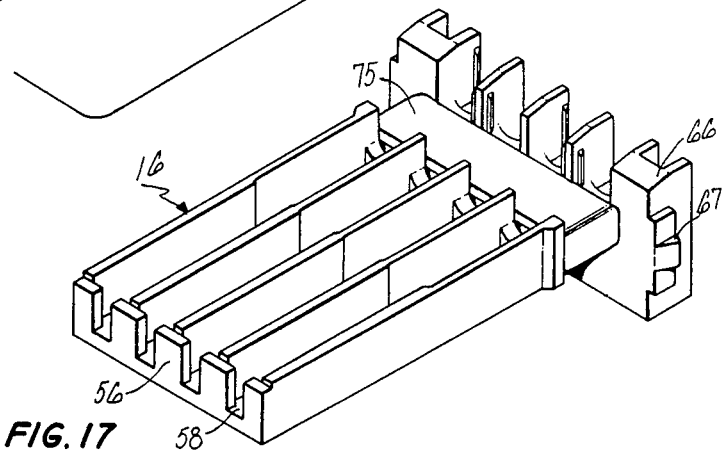
FIG. 17 depicts the terminal holder of FIG. 16 following installation of the first seal.

The terminal holder 16 and corresponding receptacle terminals 18 may be housed in connector housing 14 in a manner providing a connector assembly 12 which is relatively sealed against moisture and other elements likely to be encountered in the environment of an automobile or similar vehicle. Specifically, referring to FIGS. 16–22, a novel sealing arrangement is provided for creating a seal at the interface between terminals 18 and/or conductors 44 joined thereto, and both the terminal holder 16 and the connector housing 14. Referring to FIGS. 16 and 17, there is depicted a first, or inner, sealing member 75 formed as a continuous annular band of resilient material. Inner seal 75 is preferably formed of fluorosilicone having about 40 Shore A durometer which provides the desired resiliency and is additionally resistant to the various fluids which might be encountered in an automotive environment. The resiliency of the inner seal 75 is required both to provide a necessary sealing action and additionally to accommodate temporary expansion of the annular band during its mounting in an operative position. In fact, the inner seal 75 is manually or automatically expanded as shown in dotted line in FIG. 16 such that the terminal holder 16 may be relatively inserted therethrough until the seal is aligned with the platform 62 containing the shallow arcuate channels 64. In such position, the force for temporarily expanding the inner seal 75 is released and the seal is allowed to return toward its original geometry. Preferably the relative sizes of the inner seal 75 and the terminal holder platform 62 are such that the sealing member remains in tensile stress as depicted in FIG. 17. Thereafter, the receptacle terminals 18 with respective conductive wires 44 joined thereto may be mounted in the terminal holder 18 through locking engagement with the snap-lock fingers 70*a*, 70*b*. Such mounting of the terminals 18 causes the conductor wires 44 to pass over the outer surface of the inner seal 75 and to at least partly depress that seal into the shallow arcuate channels 64 of the terminal holder platform 62, as illustrated by the rightmost conductor 44 in FIG. 21.

A second, or outer, seal 80, depicted in detail in FIGS. 18–20, is also of continuous, generally annular configuration and is disposed about the terminal holder 16 and the conductor wires 44, radially outward of both. Outer seal 80 is typically formed of the same material as the inner seal 75. Unlike the inner seal 75 which typically has a relatively plain shape defined by parallel inner and outer surfaces, the outer seal 80 has a relatively more complex geometry. The outer surface of outer seal 80 is inwardly tapered in the forward direction and includes a pair of bosses or ribs 81 and 82 extending around its circumference. Ribs 81 and 82 are longitudinally spaced from one another, with rib 81 being adjacent the forward end of outer seal 80 and rib 82 being near the rear end of that seal. The ribs 81 and 82 are of similar size such that rib 82 projects radially outward a greater distance than does rib 81.

The interior surface of outer seal 80 is contoured to provide a large central opening 84 through which part of the terminal holder 16, the inner seal 75 and the conductor wires 44 may pass. That interior surface is generally contoured to provide an oblong opening 84 such that it smoothly and thightly engages the outer surface of the inner seal 75 in their regions of mutual contact both below and transversely outward of the terminal holder 16. However, in the region where outer seal 80 passes over the conductor wires 44, its inner surface provides a series of arcuately-contoured, longitudinally-extending slots 85 as extensions of the central opening 84. The slots 85 are in alignment with the respective terminal holder channels 54, and thus also the respective conductive wires 44, so as to closely embrace the upper portion, typically the upper half, of those conductor wires. More specifically, a further pair of bosses, or ribs, 86 and 87 are provided in the arcuate slots 85 on the inner surface of sealing member 80. The ribs 86 and 87 extend arcuately across the slots 85 with a radius which approximates that of the conductor wire 44 and are longitudinally spaced from one another, with rib 86 being relatively forward of rib 87. Unlike the outer surface of outer seal 80, its inner surface is not tapered.

The outer seal 80 is operatively positioned about the terminal holder 16, the inner seal 75 and conductor wires 44 by relatively inserting the terminal holder forwardly through the outer seal. The dimensioning of the outer seal 80 and the central opening 84 therein is such as to lightly tension that seal when it is mounted. Such tension on the outer seal 80 ensures a good sealing contact between its interior ribs 86 and 87 and the surfaces of conductor wires 44, and also between the remainder of its interior surface and the outer surface of the inner seal 75. Additionally, the outer seal 80 serves to press the conductor wires 44 downward into good sealing engagement with the inner seal 75 and such that those conductor wires in turn press the inner seal 75 into good sealing engagement with the upper surface of terminal holder platform 62.

Referring to FIGS. 1, 2 and 22, the connector housing 14 of assembly 12 is formed of molded plastic and includes an interior cavity 90 for receiving the subassembly shown in FIG. 21 consisting of the terminal holder 16, associated terminals 18 and the inner and outer seal 75 and 80, respectively. The connector housing 14 provides a substantially-continuous closure about the terminal holder 16 except for a plurality of entry ports 92 extending through its front end wall and for the relatively large opening at the rear thereof for allowing entry of the terminal holder and associated conductor wires 44.

The entry ports 92 in connector housing 14 are aligned with the entry ports 58 in the terminal holder 16 and with the opening in the forward end of the respective receptacle terminal 18. The cross-sectional geometry of the entry port 92 is substantially the same as that of the pin terminal 15 and is sized to allow entry of the pin terminal with relatively little additional clearance for the entry of fluids or dirt. The forward end of the entry port 92 may be tapered to facilitate the entry of a pin terminal 15. A resilient face seal 20, typically of the same material as the inner and outer seals 75 and 80, is positioned intermediate the forward end of the terminal holder 16 and the interior surface of the forward end of housing 14. The face seal 20 may typically be a rectangular strip having appropriate openings 94 therethrough in alignment with the entry ports 92 in housing 14 and the entry mouths in the forward end of the respective receptacle terminal 18. The openings 94 in face seal 20 are cross-sectionally smaller than the pin terminals 15 of connector 11 such that they sealingly embrace the outer periphery of those pin terminals when they are operatively inserted into mated engagement with the corresponding receptacle terminal 18.

The rear portion of connector housing 14 is transversely enlarged to accommodate the correspondingly enlarged rear portion of the terminal holder 16 with the inner and outer seal 75 and 80 mounted thereon. Additionally, the rear portion of the connector housing 14 is provided with a pair of conventional locking flanges, or arms, 95 at opposite sides thereof for engaging the lock tabs 67 on the terminal holder 16 when the terminal holder 16 is fully inserted thereinto. The locking arms 95 on housing 14 and the lock tabs 67 on terminal holder 16 are relatively positioned such that the two elements enter into locked engagement only when the terminal holder is inserted sufficiently forward in the housing as to press the face seal 20 into mutual sealing engagement with the interior surface of the forward end of the connector housing 14 and with the forward end of the terminal holder 16. The terminal holder 16 is maintained in this position when the locking arms 95 and lock tabs 67 are in their conventional locked orientation. In the event a terminal holder is used having rows of terminals mounted on opposite sides of a common base member, a similar sealing arrangement may be used but it will be understood that then both the upper and lower interior surfaces of the outer sealing ring will require slots 85.

With the terminal holder 16 fully loaded and locked into the connector housing 14, as illustrated in FIG. 22, the geometry of the interior surface of the housing toward its rearward end in the region of the outer seal 80 substantially parallels that of the seal and the two are in close continuous sealed engagement via contact between the seal ribs 81 and 82 and the interior surface of the housing. Thus it will be noted that the novel arrangement of an inner seal 75 and an outer seal 80 serving in cooperative relation with the terminal holder 16, the conductor wires 44 and the interior surface of housing 14 provide a substantially fluid-tight closure to the rear opening of the connector housing. Additionally, although the small openings 94 in the face seal 20 may afford some entry to the connector assembly 12 prior to mated insertion with a pin terminal 15, it usually is not of great concern since the connector is then under a controlled environment during manufacture and assembly in a vehicle. However, once pin terminal connector 11 is connected in mated assembly with the receptacle connector assembly 12, the environment in the region of electrical and mechanical connection between the respective terminals is substantially completely sealed.

Although this invention has been shown and described with respect to detailed embodiments thereof, it will be understood by those skilled in the art that various changes in form and detail thereof may be made without departing from the spirit and scope of the claimed invention.

Having thus described a typical embodiment of the invention, that which is claimed as new and desired to secure by Letters Patent of the United States is:

1. In a connector assembly including at least a terminal holder and an elongate terminal mounted in operative association with the terminal holder, the improvement wherein:

said terminal includes a mounting opening extending transversely through a longitudinal wall thereof; and said terminal holder includes resilient snap-lock means extending from a support member through said terminal mounting opening for substantially preventing longitudinal motion of the terminal relative to the terminal holder and for substantially independently, yieldably restricting relative motion of the terminal substantially normal to and away from said terminal holder support member.

2. The connector assembly of claim 1 wherein said snap-lock means includes at least one locking finger extending from said terminal holder support member, said at least one locking finger being resiliently deflectable in a direction longitudinally of said terminal from an unstressed position to a stressed position enabling insertion and withdrawal of said at least one locking finger through said terminal mounting opening.

3. The connector assembly of claim 1 wherein said snap-lock means includes two locking fingers extending from said terminal holder support member, at least one of said locking fingers being resiliently deflectable toward the other of said two fingers from an unstressed position to a stressed position for enabling insertion and withdrawal of said locking fingers through said terminal mounting opening.

4. The connector assembly of claim 3 wherein said two locking fingers are configured such that when in the unstressed position, their combined extreme dimension longitudinally of the terminal is greater than the corresponding dimension of the terminal mounting opening.

5. The connector assembly of claim 4 wherein each of said locking fingers includes a camming surface thereon and positioned outward from the terminal mounting member support surface for cooperatively engaging the edge of said terminal mounting opening and deflecting said fingers relatively toward one another when said terminal is moved toward said support member during mounting.

6. The connector assembly of claim 5 wherein said locking fingers extend substantially in "V"-shape fashion from the surface of said support member in longitudinally-displaced orientation.

7. The connector assembly of claim 1 wherein said terminal is a receptacle terminal having a cavity defined by a surrounding wall, said mounting opening extending through a portion of said cavity-defining wall.

8. The connector assembly of claim 7 wherein said terminal includes a pair of said mounting openings therein, said mounting openings being disposed in opposing relationship thereby to enable mounting of the terminal in the terminal holder in either of two orientations.

9. The connector assembly of claim 8 wherein said terminal holder is formed of plastic and is divided into a plurality of longitudinally-extending channels by a plurality of longitudinally-extending divider walls, the base of each said channel providing said support surface and said locking fingers being integrally formed therewith, and a respective said terminal being mounted in each said channel.

10. The connector assembly of claim 9 wherein each said channel in said terminal holder is open to the side opposing said mounting surface to facilitate the relative insertion and withdrawal of said locking fingers through said terminal mounting opening, and further including a connector housing adapted to removably receive said terminal holder therewithin to provide a closure to said open side of each said channel when a terminal is mounted therein.

* * * * *